US009015866B2

(12) United States Patent
Watanabe

(10) Patent No.: US 9,015,866 B2
(45) Date of Patent: Apr. 28, 2015

(54) GLOVE AND ATTACHMENT THEREFOR

(75) Inventor: Masaei Watanabe, Tokyo (JP)

(73) Assignee: NDC Corporation, Tokyo (JP)

( * ) Notice: Subject to any disclaimer, the term of this patent is extended or adjusted under 35 U.S.C. 154(b) by 55 days.

(21) Appl. No.: 13/061,982

(22) PCT Filed: Sep. 9, 2008

(86) PCT No.: PCT/JP2008/066246

§ 371 (c)(1),
(2), (4) Date: Mar. 3, 2011

(87) PCT Pub. No.: WO2010/029614

PCT Pub. Date: Mar. 18, 2010

(65) Prior Publication Data

US 2011/0179550 A1 Jul. 28, 2011

(51) Int. Cl.
*A41D 19/00* (2006.01)

(52) U.S. Cl.
CPC ..... *A41D 19/0024* (2013.01); *A41D 2400/44* (2013.01)

(58) Field of Classification Search
CPC ..... A41D 19/0024; A41D 2400/44
USPC ..... 2/158, 159, 160, 161.1, 161.2, 161.6, 2/161.7, 163, 19, 20; 482/47, 48, 49, 50; 602/21, 22
See application file for complete search history.

(56) References Cited

U.S. PATENT DOCUMENTS 1,045,231 A * 11/1912 Whitley ..... 2/19
1,490,174 A * 4/1924 Kennedy ..... 2/19
1,631,735 A * 6/1927 Kennedy et al. ..... 2/19
1,826,851 A * 10/1931 Whitley ..... 2/19
2,113,934 A * 4/1938 Denkert ..... 2/19
2,380,633 A * 7/1945 Daiber ..... 2/158
2,522,344 A * 9/1950 Carmin ..... 2/160
2,625,686 A * 1/1953 Latina ..... 2/19
2,937,379 A * 5/1960 Mackay et al. ..... 2/158
3,408,657 A * 11/1968 Gallagher ..... 2/159
4,815,729 A * 3/1989 Stefanski ..... 482/48
5,018,221 A * 5/1991 Romandetto ..... 2/16
5,022,094 A * 6/1991 Hames et al. ..... 482/105
5,224,220 A 7/1993 Andriola
5,613,923 A * 3/1997 Anliker ..... 482/105
6,070,266 A * 6/2000 Terashita et al. ..... 2/19
6,526,592 B1 * 3/2003 Best ..... 2/161.1

(Continued)

FOREIGN PATENT DOCUMENTS

JP 30116/1994 4/1994
JP 11-267263 A 10/1999

(Continued)

*Primary Examiner* — Amy Vanatta
*Assistant Examiner* — Sally Haden
(74) *Attorney, Agent, or Firm* — Pearne & Gordon LLP

(57) ABSTRACT

There is included a hooking cord 52 disposed on the back side of said finger insertion parts and held in and over at least three finger insertion parts 40C, 40D and 40E corresponding to a middle finger, a third finger and a little finger among the five finger insertion parts 40A through 40E of the glove body 10B so as to adjust a distance between the adjacent finger insertion parts whereby the three finger insertion parts can be pulled simultaneously by hooking the hooking cord 52 with a little finger of a hand not wearing the glove and grasping the finger insertion parts 40A and 40B corresponding the thumb and the first finger with a thumb and a first finger of the hand not wearing the glove 10.

7 Claims, 7 Drawing Sheets

(56) References Cited

U.S. PATENT DOCUMENTS

| | | | | |
|---|---|---|---|---|
| 7,582,030 | B2 * | 9/2009 | LaPergola | 473/450 |
| 2004/0186402 | A1 * | 9/2004 | Bennett | 2/163 |
| 2007/0226872 | A1 | 10/2007 | Huh | |

FOREIGN PATENT DOCUMENTS

| | | | |
|---|---|---|---|
| JP | 2002-159611 | A | 6/2002 |
| JP | 3122714 | U | 6/2006 |

* cited by examiner

GLOVE AND ATTACHMENT THEREFOR

TECHNICAL FIELD

This invention relates to a glove adapted to be able to be easily removed by a wearer and an attachment therefor and relates to a glove having a structure suitable for a sport glove such as a golf glove and a baseball glove (a glove used on batting in a baseball) required to be frequently worn and removed during playing.

BACKGROUND OF TECHNOLOGY

In general, the glove comprises a back part, a palm part and five finger insertion parts extending from the back and palm parts. The sport glove such as a golf glove is worn by a player so as to be able to open and close to the back parts a closing piece extending from the palm part by a surface fastener.

For example, a golf player will sometimes remove its glove for various reasons not only after the end of the play, but also during playing. For instance, when carrying out an approach shot or a putting or when taking out something from its caddie bag between adjacent greens, the golf player may sometimes remove its golf glove.

In the case of performing the approach shot or the putting, it is required to remove the golf glove as soon as possible in order to play quickly. In order that the golf player is able to grasp a golf club while the golf glove closely engages the golf club, in general, the golf glove is worn by the player while closely engaging the back, the palm and the fingers of the player. Therefore, it takes considerable time to remove the golf glove and especially, since the finger insertion parts are removed while individually pulling the tops of the finger insertion parts one by one, it takes substantial time to remove all the finger insertion parts out of the fingers corresponding to the finger insertion parts. Since the golf glove more closely engages the hand at the time of play in rain than at that when it does not rain, it would be much more difficult to remove the golf glove.

The reason why the golf player removes the golf glove when carrying out the approach shot or the putting is that it tends to control the golf club more easily when it grasps the golf club with empty hands than otherwise. There are some conventional golf clubs adapted to get the same state as if the golf glove is removed by partially thinning the third, fourth and fifth finger insertion parts of the golf glove (see Patent Document 1)

However, the golf glove having such a structure has a complicated structure, its manufacture is troublesome and in addition thereto, it is difficult to effectively make a control of the approach shot or the putting as played with the empty hand even if the finger insertion parts are partially thinned. It would be more preferable if the golf glove could be easily removed. If the golf glove could be removed easily, it would be also convenient when it is required to remove the golf glove at the time other than when the approach shot or the putting is performed.

There have been proposed various structures of a general glove adapted to easily remove the glove. For example, there has been proposed a fingertip-opened type glove having a finger hooking ring portion provided near a tip of an awith rbitrary finger insertion part on the back side of the glove so as to cross the finger insertion part in the direction where the finger extends (see Patent Documents 2). The glove of such a structure can be removed by hooking the finger engaging ring any finger of the opposite hand. However, in the case of the sport glove, since the palm is a side where the club, the bat or the like is grasped, it will interfere with grasping the club, the bat, etc. and in order to remove the glove quickly, it is necessary to provide the finger hooking ring in as many finger insertion parts as possible. But, since this requires every finger insertion parts to be hooked by the corresponding finger of the opposite hand, it takes considerable time for the hooking operation of all the fingers which is ready to remove the glove and therefore, this operation will disadvantageously interfere with removing the glove quickly.

There has been proposed a structure of a glove in which a string is connected between the adjacent finger penetration ports of the glove having no finger insertion parts (see Patent Documents 3). Even if such a structure may be applied to the glove having finger insertion parts, the strings are located at a root between all the finger insertion parts and therefore when the strings between the adjacent finger insertion parts should be hooked by the corresponding fingers, respectively, similarly, it takes substantial time to remove the glove. Further, since there are interposed the hooking strings between the adjacent finger insertion parts, the close engagement between the fingers of the hand will be interfered. It is not preferable for grasping the club, the bat or the like in case of being used as the sport glove grasping it. Furthermore, since the second finger is restrained by the string, when it is used as the golf glove, the golf clubs cannot be gripped.

[Patent Documents 1] JP11-267263A
[Patent Documents 2] Registered utility model No. 3122714
[Patent Documents 3] JU6-30116A

DISCLOSURE OF THE INVENTION

Problems to be Solved by the Invention

One of the problems to be solved by the invention is to provide a glove in which a distance between adjacent fingers when it is worn is never restrained, a close engagement of the adjacent fingers is never interfered with and a glove body in the state of being worn can be removed out of every fingers simultaneously in a single operation.

Another problem to be solved by the invention is to provide attachment for a glove suitable for being used while attached to a glove body of the glove so that a distance between adjacent fingers when the glove is worn is never restrained, a close engagement of the adjacent fingers is never interfered with and the glove body in the state of being worn can be removed out of every fingers simultaneously in a single operation.

Means to Solve the Problems

A first means to solve one of the problems is to provide a glove comprising a glove body including a back part and a palm part integrally joined to each other so as to cover a back and a palm of a hand of a wearer and five finger insertion parts extending from ends of said back part and said palm to cover each finger of said wearer, respectively, said glove further characterized by being provided with glove body removal means including one hooking cord disposed on the back side of said finger insertion parts and attached over and to three finger insertion parts corresponding only to a middle finger, a third finger and a little finger among said five finger insertion parts of said glove body so as to adjust a distance between adjacent finger insertion parts whereby said three finger insertion parts can be pulled simultaneously while said hooking cord is hooked by a little finger of an empty hand.

In the first means to be solved by the invention, the glove body removal means further includes fixing portions where both ends of said hooking cord are fixed to said finger insertion parts for said middle and little fingers, respectively and a holding portion where a middle portion of said hooking cord is held.

In this case, the holding portion preferably holds said hooking cord at the finger insertion part corresponding to the third finger so that said hooking cord can move in a lateral direction relative to said third finger insertion part.

The fixing portions may be formed by fixing the hooking cord directly to the finger insertion parts or may comprise a fixing piece fixed to the hooking cord and attached to the finger insertion parts by sewing, thermal melting adhesion, adhesive or surface attachment.

On the other hand, the holding portion may comprise a cloth portion between a pair of longitudinal slits which are provided in the back side of the finger insertion part corresponding to the third finger and which the hooking cord penetrates or may comprise a holding piece attached to the back side of the finger insertion part corresponding to the third finger so that the hooking cord extends through the holding piece.

The second means to be solved by the invention is to provide an attachment to be attached onto a glove comprising a glove body including a back part and a palm part integrally joined to each other so as to cover a back and a palm of a hand of a wearer and five finger insertion parts extending from ends of said back part and said palm to cover each finger of said wearer, respectively, said attachment characterized by comprising glove body removal means including one hooking cord disposed on the back side of said finger insertion parts and attached over and to three finger insertion parts corresponding only to a middle finger, a third finger and a little finger among said five finger insertion parts of said glove body so as to adjust a distance between adjacent finger insertion parts whereby said three finger insertion parts can be pulled simultaneously while said hooking cord is hooked by a little finger of an empty hand.

In the second means to be solved by the invention, the glove body removal means includes fixing portions where both ends of said hooking cord are fixed to said finger insertion parts for said middle and little fingers, respectively and a holding portion where a middle portion of said hooking cord is held. The holding portion may preferably comprise a holding piece to be attached by sewing, thermal melting adhesion, adhesiven or surface attachment to the finger insertion part corresponding to the third finger so that the hooking cord is held in the finger insertion part while the hooking cord is allowed to move in a lateral direction.

Effect of the Invention

According to the invention, since the glove comprises glove body removal means including a hooking cord disposed on the back side of said finger insertion parts and attached over and to three finger insertion parts corresponding only to the middle finger, the third finger and the little finger among the five finger insertion parts of the glove body so as to adjust a distance between the adjacent finger insertion parts whereby the three finger insertion parts can be pulled simultaneously while said hooking cord is hooked by the little finger of the empty hand.

Since the glove can freely adjust the distance between each another of the finger insertion parts, there is no problem in grasping the club, the bat or the like when it is applied to the sport glove such as the golf glove or the baseball glove. Especially, as the hooking cord can move laterally relative to the third finger, the third finger can more freely control the distance relative to the middle finger and the little finger on both sides thereof and therefore the finger insertion parts are never restrained. Since the hooking cord is provided so that it never enters the space between the adjacent fingers, the mutual close engagement of the fingers is never prevented and the feeling of free use can be imparted to the glove in the same manner as that of the glove having no hooking cord.

Since the glove body removal means can be attached to the glove by fixing the hooking cord itself or its fixing piece and its holding piece to the finger insertion parts by sewing, thermal melting adhesion, adhesive or surface attachment, its manufacture is easy and also it may be easily attached to the already existing glove having no glove body removal means.

BRIEF DESCRIPTION OF THE DRAWINGS

FIG. 4 illustrates a fixing portion and a holding portion of the glove body removal means of FIG. 3, in which FIG. 4(A) is a cross sectional view taken along a line A-A of FIG. 3 in order to show the fixing portion and FIG. 4(B) is a cross sectional view taken along a line B-B of FIG. 3 in order to show the holding portion;

FIG. 8 illustrates a fixing portion and a holding portion of the glove body removal means of FIG. 7, in which FIG. 8(A) is a cross sectional view taken along a line A-A of FIG. 7 ion order to show the fixing portion and FIG. 8(B) is a cross sectional view taken along a line B-B of FIG. 7 in order to show the holding portion; and FIG. 9 illustrates an attachment for a golf glove suitable for being attached to the golf glove and easily removing the golf glove, in which FIG. 9(A) is a front view thereof and FIG. 9(B) is a longitudinal cross sectional view thereof.

BEST MODE OF EMBODIMENT OF INVENTION

A best form for carrying out the invention will be explained based on the drawings later. A glove 10 according to one form of embodiment of the invention is described with reference to FIGS. 1 through 3. Although the glove 10 is shown to be a golf glove in the illustrated form, the invention may be applied to sport gloves other than the golf glove and other general gloves in addition to a golf glove. This glove may be made of natural leather, synthetic leather or other proper material.

Figure 1:
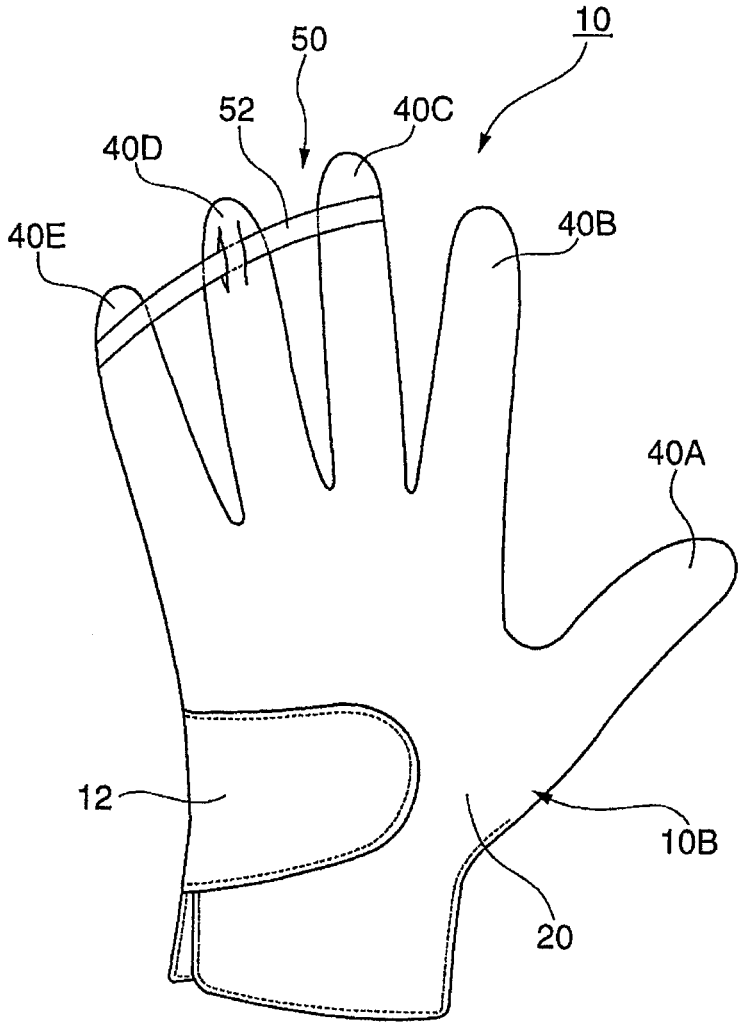
FIG. 1 is a front view of a golf glove constructed in accordance with one form of embodiment of the invention.

The glove 10 has a glove body 10B comprising a back part 20 and a palm part 30 joined to each other so as to wrap the back and palm of a hand of a wearer and five finger insertion parts 40A, 40B, 40C, 40D and 40E formed by extending from the leading ends of the back and palm parts 20 and 30. and to cover each fingers of the hand of the wearer. In FIG. 1, a reference numeral 12 designates a closing piece for closing an opening between the back and palm parts 20 and 30 on the side of the wrist of the hand with a surface fastener to prevent the glove body 10B from being removed from the hand.

The glove 10 of the invention further includes glove body removal means 50 having a single hooking flexible cord 52 disposed on the back side of three finger insertion parts 40C, 40D and 40E corresponding to a middle finger, a third finger and a little finger respectively, among the five finger insertion parts 40A through 40E of the glove body 10B and attached over and to the three finger insertion parts so as to adjust a distances between the adjacent finger insertion parts 40C and 40D or 40D and 40E whereby these three finger insertion parts can be pulled simultaneously while the hooking cord 52 is hooked by a little finger of an empty hand. The hooking cord 52 may be also made of the same material as that of the glove body 10B, but if the hooking cord can be fixed to the finger insertion parts, it may be made of different material such as plastic string, plastic strip or other material.

The glove body removal means 50 further includes fixing portions 54C and 54E where both ends of the hooking cord 52 are fixed to the finger insertion parts 40C and 40E for the middle and little fingers, respectively and a holding portion 54D where a middle portion of the hooking cord 52 is held at the finger insertion part 40D for the third finger. In the illustrated form, the holding portion 54D holds the finger insertion part 40D for the third finger so that the hooking cord 52 can move laterally relative to the finger insertion part 40D corresponding to the third finger.

Figure 4:
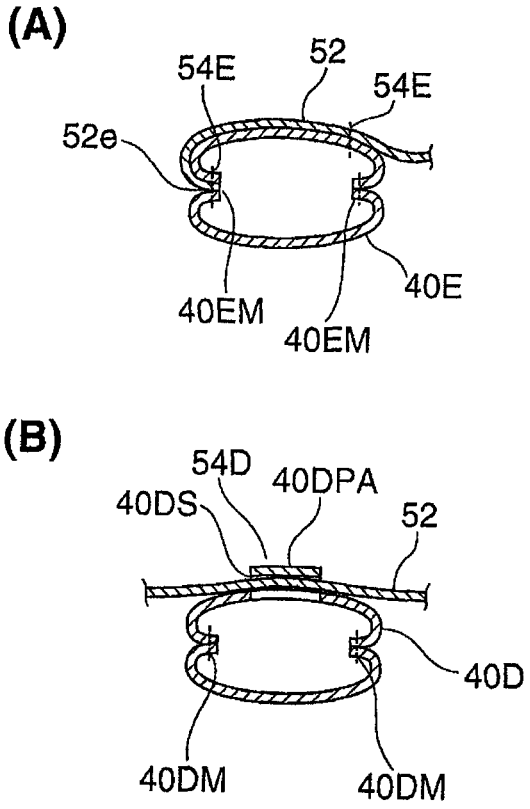

In the illustrated form, the fixing portions 54C and 54E are formed by sewing on the hooking cord 52. Explaining with reference to FIG. 4 in more details, the fixing portion 54E is formed as shown in FIG. 4(A) by inserting the end 52*e* of the cord 52 into the outside sewing portion 40EM of the back-side and palm-side clothes of the finger insertion part 40E and sewing the former onto the latter and also sewing the cord portion corresponding to the inside sewing portion 40EM of the back-side and palm-side cloths of the finger insertion part 40E or the cord portion further inside thereof to the back-side cloth portion of the finger insertion part 40E. The fixing part 54C may be formed similarly, but it may be formed in the same manner as the form in which the side of the finger insertion part 40C facing the first finger is inserted in the same form as the outside form of the outside sewing portion 40E of the fixing portion 54E inserted and by sewing the side of the finger insertion part 40C facing the third finger to the back-side cloth portion of the finger insertion part 40C in the same form as the inside form of the fixing portion 54E. Otherwise, the end 52*e* of the cord 52 may be sewn to the back-side cloth portion of the finger insertion part 54E without any insertion of the end 52*e* of the cord 52 into the outside sewing portion 40EM of the finger insertion part 54E. In the illustrated form, the cord 52 is fixed to both sides of the finger insertion parts 40C and 40E, but may be fixed only to either of both sides thereof. In any case, it is required that the cord 52 is never exposed on the side of the palm or never enters the space between the adjacent fingers whereby the close engagement of the adjacent fingers to each other caused by the cord 52 interposed between the adjacent fingers is never prevented when the glove is worn. Normally, the middle finger insertion 40C and the first finger insertion part 40B are never closely engaged with each other when the golf club is gripped (see FIG. 6) and therefore, there is no trouble even if the other end (the end opposite to the end 52*e*) of the cord 52 is inserted into the sewing portion of the first finger insertion part 40C on the side of the first finger insertion part 40B, but this end of the cord may be sewed to the back-side cloth portion of the finger insertion part further inside of the sewing portion.

Figure 3:
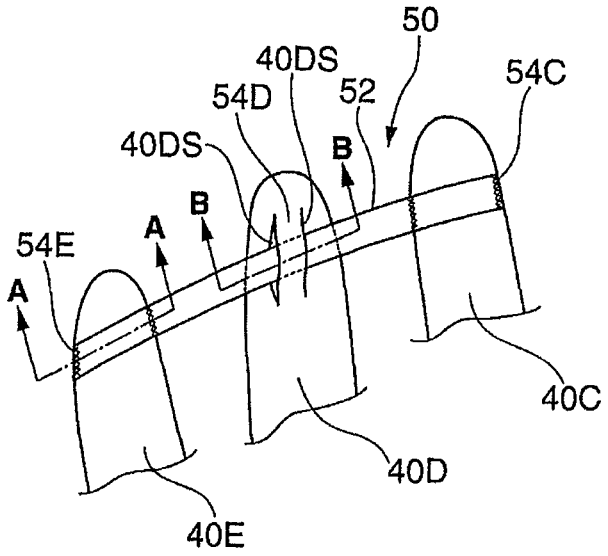
FIG. 3 is an enlarged front view of glove body removal means of the golf glove of FIGS. 1 and 2.

In the illustrated form, the holding portion 54D comprises a cloth piece 40DPA between a pair of longitudinal slits 40DS provided in the back side cloth of the finger insertion part 40D for the third finger and through which the hooking cord 52 extends (see FIGS. 3 and 4 (B)). The hooking cord 52 is held at the finger insertion part 40D by extending through these longitudinal slits 40DS so that it passes through the inner face of the cloth piece 40DPA whereby the cord 52 is able to move freely in a transverse direction through these longitudinal slits 40DS. In FIG. 4 (B), reference numerals 40DM designate the sewing portions of the back-side and palm-side cloth portions of the finger insertion part 40D.

Figure 2:
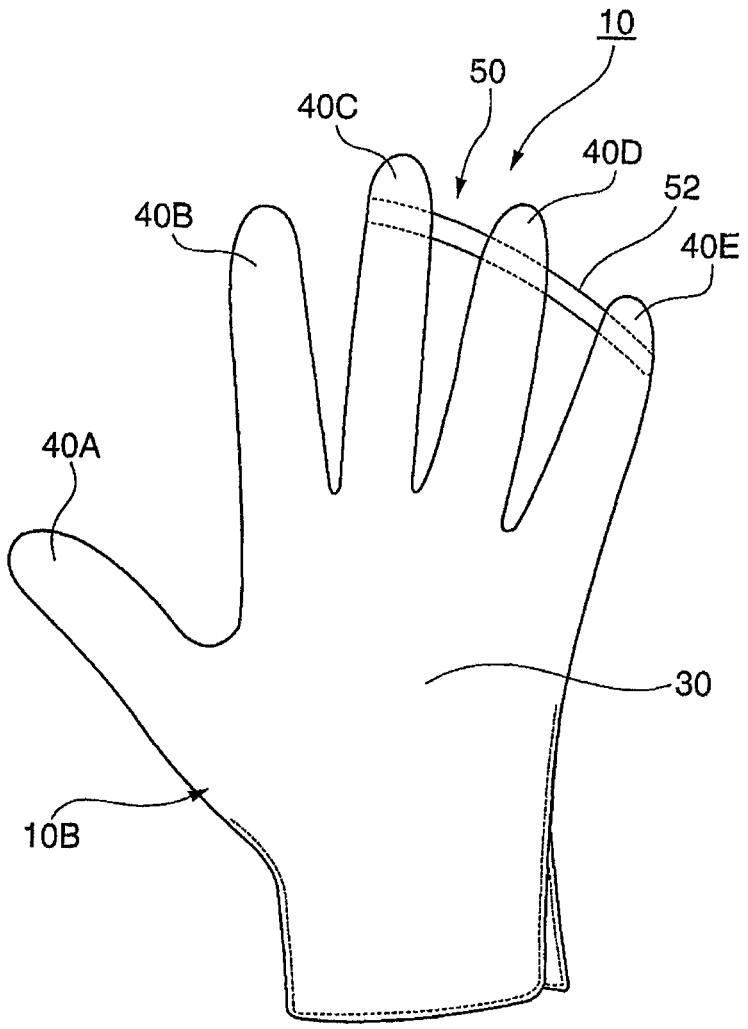
FIG. 2 is a back view of the golf glove of FIG. 1.
Figure 6:
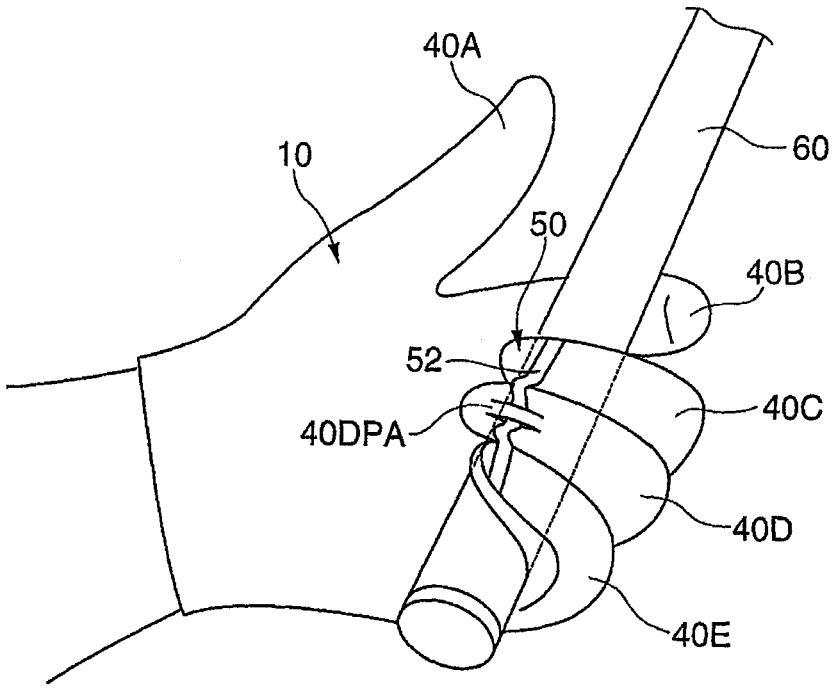
FIG. 6 is a perspective view in the state where the golf glove of FIG. 2 is worn and the golf club is grasped.

Next, explaining a state where the golf glove 10 shown in FIGS. 1 and 2 is used, this golf glove 10 will be used with the glove body 10B engaged in a left hand (in the case of a right-handed person) as usually. The length of the hooking cord 52 of the glove body removal means 50 is so set as to be able to adjust the distance between the adjacent finger insertion parts 40C and 40D or between the adjacent finger insertion parts 40D and 40E of the finger insertion parts 40C through 40E corresponding to the middle finger, the third finger and the little finger, respectively, and the hooking cord 52 is held in the glove body 10B so that the cord is able to move in the traverse direction relative to the finger insertion part 40D corresponding to the third finger. Thus, when a player wears the golf glove 10 or when it grips a golf club through the golf glove 10 as shown in FIG. 6, the hooking cord 52 never restrains the distance between two of these finger insertion parts 40C, 40D and 40E and therefore causes no trouble. Especially, since the hooking cord 52 is disposed along the back side of the finger insertion parts 40C, 40D and 40E and the hooking cord 52 itself and its fixing portions 54C and 54E never enter between the adjacent fingers, this golf glove never damages contact feeling on the palm side and between the adjacent fingers from the middle finger to the little finger in the same manner as the conventional glove having no glove body removal means and the hooking cord 52 can closely engage these fingers to each other. In case that the glove is the golf glove, the close engagement between the palm face and the golf club and between the adjacent fingers from the middle finger to little finger is extremely important for gripping the golf club. The glove of FIGS. 1 through 4 is more advantageous because the close engagement between the palm and the golf club and between the adjacent fingers is never damaged.

Figure 5:
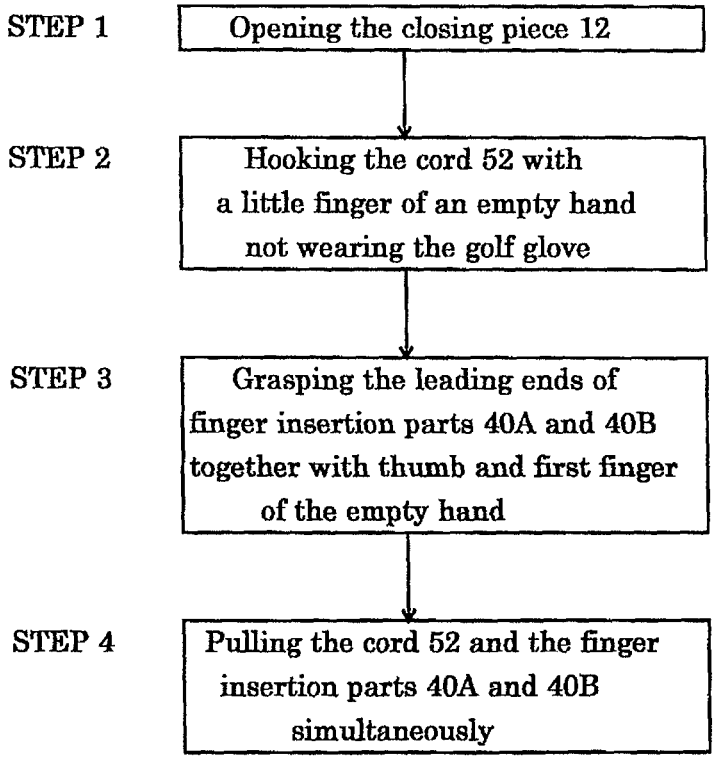
FIG. 5 is a block diagram showing the procedure when the golf glove of FIG. 2 is removed.

In case where the wearer (player) wants to remove the golf glove at the time such as the as the player makes an approach shot or a putting, firstly the player opens the closing piece 12 (see a step 1 of FIG. 5), hooks the hooking cord 52 of the glove body removal means 50 between the middle and third fingers or between the third and little fingers with a little finger of an opposite hand (an empty hand) not wearing the golf glove (see a step 2 of FIG. 5), grasping the leading ends of the finger insertion parts 40A and 40B corresponding to the thumb and the first finger together between and with a thumb and a first finger of the empty hand (see a step 3 of FIG. 5) and, in this state, pulls the hooking cord 52 and the finger insertion parts 40A and 40B simultaneously (see a step 4 of FIG. 5). In this manner, all the finger insertion parts 40A through 40E are pulled out of the corresponding thumb and fingers at the same time in a smooth manner whereby the golf glove 10 can be removed out of the hand in a single operation. The method to grasp the finger insertion parts 40A and 40B corresponding to the thumb and the first finger, respectively may be performed in a manner other than the aforementioned method to grasp them between the thumb and the first finger of the empty hand. The leading ends of the finger insertion parts 40A and 40B may be grasped between the thumb and the first finger and between the first and middle fingers, respectively. Also, in this case, by hooking the hooking cord 52 with the little finger of the empty hand, the whole glove body 10B can be drawn or pulled out simultaneously.

Figure 7:
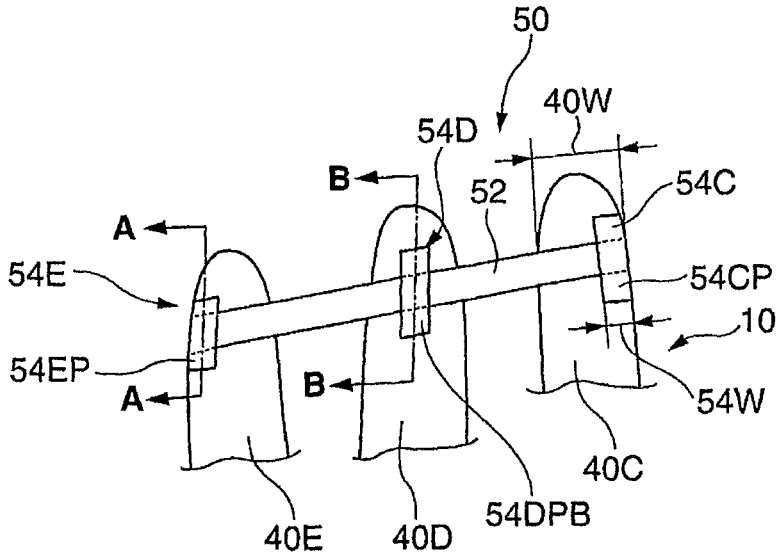
FIG. 7 is an enlarged front view of glove body removal means according to another form of embodiment of the invention.
Figure 8:
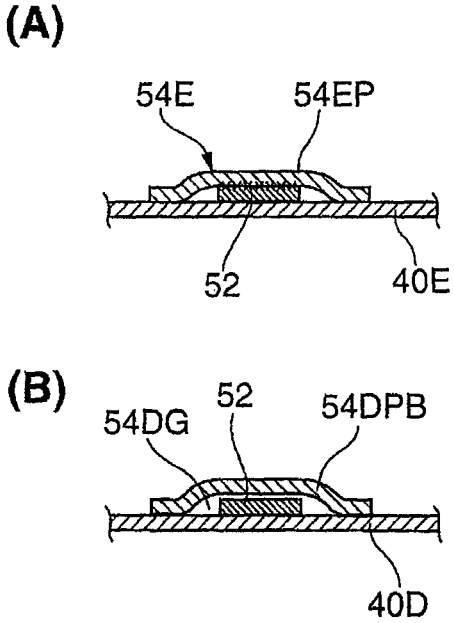

Another form of the invention is shown in FIGS. 7 and 8 and in this form, the fixing portions 54C and 54E may comprise fixing pieces 54CP and 54EP fixed to the hooking cord 52 and attached to the back side of the finger insertion parts 40C and 40E and the holding portion 54D may comprise a holding piece 54DPB attached to the back side of the finger insertion part 40D corresponding to the third finger so that the hooking cord 52 can extend through the holding piece 54DPB.

The fixing piece 54CP and 54EP may be fixed to the hooking cord 52 by either of sewing, thermal melting adhesion or adhesive, but the most preferable fixing means is the sewing illustrated (see FIG. 8 (A)). The fixing pieces 54CP and 54EP and the holding piece 54DPB may be attached to the finger insertion parts 40C, 40E and 40D, respectively by either of sewing, thermal melting adhesion, adhesive and surface adhesion (surface fastener). The illustrated fixing means is shown to be adhesive (see FIG. 8(A)(B)). Although the fixing pieces 54CP and 54EP and the holding piece 54DPB have a width 54W considerably smaller than width 40W of the back side of the finger insertion parts 40C, 40E and 40D, the width 54W of the fixing pieces 54CP and 54EP and the holding piece 54DPB may be broader to the width near the width 40W within the limit of the width 40W of the back side of the finger insertion parts 40C, 40E and 40D. In FIG. 8 (B), a reference numeral 54DG designates a gap formed between the back side cloth of the finger insertion part 40D and the holding piece 54DPB so that the hooking cord 52 can freely move in a transverse direction (a direction traversing the finger) between the back side cloth of the finger insertion part 40D and the holding piece 54DPB.

In the form of embodiment of FIGS. 7 and 8, as long as the fixing pieces 54CP, 54EP and 54DPB can withstand the pulling force, they may be fixed to the finger insertion parts 40C, 40E and 40D with a surface fastener (surface fixture) etc., respectively.

Although the invention provides an attachment 10AC adapted to be attached to a already existing glove having no glove body removal means 50 as a retrofit product or a product to be attached late. The detail of one form of embodiment of the attachment is illustrated in FIG. 9.

Figure 9:
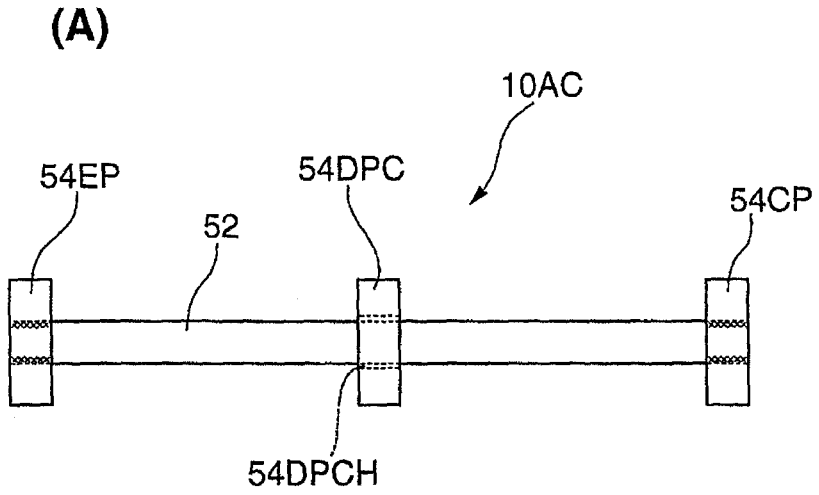
Figure 9:
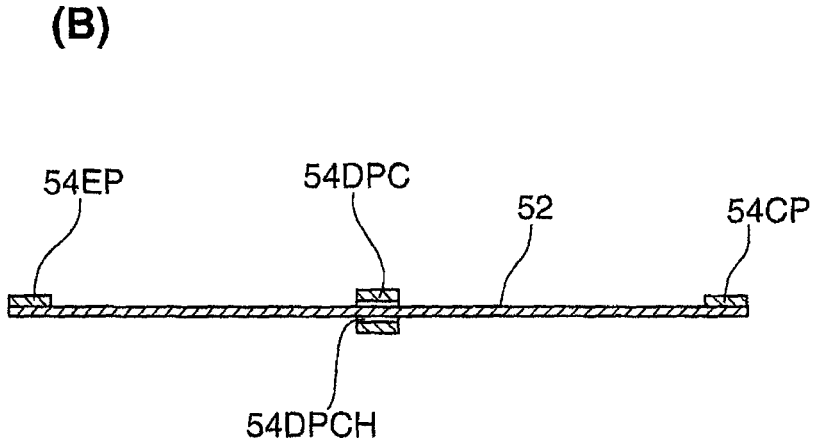

As shown in FIG. 9, the attachment 10AC corresponds to a structural body of the glove body removal means 50 independently separated from the golf glove 10 of FIG. 1 or 7. More particularly, the attachment 10AC includes the hooking cord 52, the fixing piece 54CP and 54EP to fix both ends of the hooking cord 52 to the finger insertion parts 40C and 40E for the middle and little fingers (see FIGS. 1 and 2, ditto later), respectively and the holding piece 54DPC to hold the middle portion of the hooking cord 52 at the third finger insertion part 40D so that the cord 52 can move rightward or leftward.

The fixing pieces 54CP and 54EP may be fixed to the hooking cord 52 by sewing, thermal melting adhesion or adhesive while the holding piece 54DPC has a penetration hole 54DPCH which the hooking cord 52 penetrates so that the hooking cord 52 can move rightward or leftward. If the holding piece 54DPC can be held the hooking cord 52 until the attachment 10AC is attached to the glove body 10B, then the penetration hole 54DPCH may not be required to be provided and the holding piece 54DPC may hold the hooking cord 52 by a holding string, for example. In this case, as the holding piece 54DPC is fixed to the finger insertion part 40D, the hooking cord 52 will be held at the finger insertion part 40D so that the cord can move rightward or leftward between the holding piece 54DPC and the finger insertion part 40D.

The fixing pieces 54CP and 54EP and the holding piece 54DPC may have a pressure adhesive layer with a release paper attached thereto or a thermal melting adhesion layer with a release paper attached thereto on the undersurface thereof (the surface facing the finger insertion part). The fixing pieces 54CP and 54EP and the holding piece 54DPC can be attached to the corresponding finger insertion parts by pressurizing the pressure adhesive layer to the corresponding finger insertion parts or forcing the thermal melting adhesion layer while it is heated with an iron etc. after the release paper is removed.

The glove (the golf glove, for example) having the same structure as that shown in FIGS. 1 and 2 can be obtained by attaching the fixing pieces 54CP and 54EP and the holding piece 54DPC of the attachment 10AC to the finger insertion parts 40C, 40E and 40D of the glove body 10B, respectively.

The fixing piece 54CP and 54EP may not necessarily be required and it may have a fixing material formed of a pressure adhesive layer with a release paper or a thermal melting adhesion layer with a release paper provided on the undersurface of the both ends of the hooking cord 52.

POSSIBILITY OF UTILIZATION IN INDUSTRIES

Since all the finger insertion parts of the glove of the invention can be pulled out of the corresponding fingers by hooking the hooking cord with the little finger of the hand (empty hand) not wearing the glove and grasping the finger insertion parts corresponding to the thumb and the first of the golf glove with the thumb and the first fingers etc., of the empty hand, the glove can be removed in a single operation and therefore the removal operation of the glove can be easily made, which can improve the possibility of utilization in industries.

The invention claimed is:

1. A glove comprising a glove body including a back part and a palm part integrally joined to each other and five finger insertion parts, comprising a thumb finger insertion part, a first finger insertion part, a middle finger insertion part, a third finger insertion part, and a little finger insertion part, each of the five finger insertion parts extending from ends of said back part and said palm part and each having a closed leading end, said glove for golfing or baseball batting adapted to be worn so as not to be able to be removed without resistance, said glove further characterized by being provided with glove body removal means including a single hooking flexible cord disposed only on the back side of said finger insertion parts and over only three finger insertion parts corresponding to said middle finger insertion part, said third finger insertion part and said little finger insertion part of said glove body and having two ends with a length therebetween sufficient for allowing an adjustment of a distance between the adjacent finger insertion parts of said three finger insertion parts, and said glove body removal means further including fixing portions where respective ends of said single hooking flexible cord are fixed to the back side of said middle and little finger insertion parts, and a holding portion where a middle portion of said single hooking flexible cord is held on the back side of said third finger insertion part so that said hooking flexible cord can freely move in a lateral direction relative to said third finger insertion part so that said single hooking cord is movable through the third finger insertion part so as to adjust a distance between the adjacent finger insertion parts of said three finger insertion parts to thereby freely move said adjacent finger insertion parts relative to each other whereby said middle, little and third finger insertion parts can be pulled simultaneously while hooking said single hooking flexible cord for glove body removal.

2. A glove as set forth in claim 1, and wherein said fixing portions are formed by fixing said hooking flexible cord directly to the back side of said finger insertion parts.

3. A glove as set forth in claim 1, and wherein said fixing portions comprise a fixing piece fixed to said hooking flexible cord and attached to the back side of said finger insertion parts by sewing, thermal melting adhesion, adhesive or surface attachment.

4. A glove as set forth in claim 1, and wherein said holding portion comprises a cloth portion between a pair of longitudinal slits which are provided in the back side of said third finger insertion part and through which said hooking flexible cord penetrates.

5. A glove as set forth in claim 1, and wherein said holding portion comprises a holding piece attached to said back side of said third finger insertion part so that said hooking flexible cord extends through said holding piece.

6. An attachment attached onto a glove comprising a glove body including a back part and a palm part integrally joined to each other and five finger insertion parts, comprising a thumb finger insertion part, a first finger insertion part, a middle finger insertion part, a third finger insertion part, and a little finger insertion part, each of the five finger insertion parts extending from leading ends of said back part and said palm part and each having a closed leading end, said glove for golfing or baseball batting adapted to be worn so as not to be able to be removed without any resistance, said attachment characterized by comprising glove body removal means including a single hooking flexible cord disposed only on the back side of said finger insertion parts and over only three finger insertion parts corresponding to said middle finger insertion part, said third finger insertion part and said little finger insertion part and having two ends with a length therebetween sufficient for allowing an adjustment of the adjacent finger insertion parts of said three finger insertion parts, and said glove body removal means further including fixing portions where respective ends of said single hooking flexible cord are fixed to the back side of said middle and little finger insertion parts, and a holding portion where a middle portion of said single hooking flexible cord is held on the back side of said third finger insertion part so that said single hooking flexible cord can freely move in a lateral direction relative to said third finger insertion part so that said single hooking cord is movable through the third finger insertion part so as to adjust a distance between adjacent finger insertion parts of said three finger insertion parts whereby said middle, little and third finger insertion parts can be pulled simultaneously while hooking said single hooking flexible cord.

7. An attachment as set forth in claim 6, said holding portion comprises a holding piece to be attached by sewing, thermal melting adhesion, adhesive or surface attachment to the back side of said third finger insertion part so that said hooking flexible cord is held at the back side of said finger insertion part while said hooking flexible cord is allowed to move through said third finger insertion part in a lateral direction.

* * * * *